US007980401B1

(12) United States Patent
Staraitis

(10) Patent No.: US 7,980,401 B1
(45) Date of Patent: Jul. 19, 2011

(54) SHELVING SYSTEM

(76) Inventor: John A. Staraitis, Garfield Heights, OH (US)

( * ) Notice: Subject to any disclaimer, the term of this patent is extended or adjusted under 35 U.S.C. 154(b) by 219 days.

(21) Appl. No.: 12/416,642

(22) Filed: Apr. 1, 2009

(51) Int. Cl.
*A47F 5/08* (2006.01)

(52) U.S. Cl. ..... 211/90.01; 211/113

(58) Field of Classification Search ..... 211/90.01, 211/87.01, 88.01, 113, 117, 119.003, 118; 108/182, 164, 149, 23, 42, 44; 312/247, 312/245; 248/214, 317; 206/806
See application file for complete search history.

(56) References Cited

U.S. PATENT DOCUMENTS

| | | | | | |
|---|---|---|---|---|---|
| 865,790 | A | * | 9/1907 | Mayer | 108/100 |
| 1,225,607 | A | * | 5/1917 | Ford et al. | 108/164 |
| 1,277,781 | A | * | 9/1918 | Trammell | 5/94 |
| 1,928,731 | A | * | 10/1933 | Mattson | 108/44 |
| 2,051,241 | A | * | 8/1936 | Biggers | 108/149 |
| 2,205,193 | A | * | 6/1940 | Goldman | 108/135 |
| 2,244,887 | A | * | 6/1941 | Manley | 312/6 |
| 2,657,810 | A | * | 11/1953 | Garrick | 108/31 |
| 2,818,317 | A | * | 12/1957 | Little, Jr. | 108/44 |
| 2,947,585 | A | * | 8/1960 | Fazio | 108/44 |
| 3,025,970 | A | | 3/1962 | Ostrom | |
| 3,592,146 | A | * | 7/1971 | Loomans | 108/149 |
| 3,799,072 | A | * | 3/1974 | Slaboden | 108/107 |
| 4,295,432 | A | * | 10/1981 | Hulke | 108/149 |
| 4,523,526 | A | | 6/1985 | O'Neill | |
| 4,884,935 | A | * | 12/1989 | Smith et al. | 414/498 |
| 5,052,648 | A | | 10/1991 | Landau | |
| 5,350,071 | A | * | 9/1994 | Pond | 211/70.6 |
| 6,311,626 | B1 | | 11/2001 | Roberts | |
| 6,715,427 | B2 | | 4/2004 | Mikich et al. | |
| D525,811 | S | | 8/2006 | Nawrocki | |
| 7,191,788 | B2 | * | 3/2007 | Holub et al. | 135/93 |
| 2004/0123781 | A1 | * | 7/2004 | D'Agostino | 108/42 |

FOREIGN PATENT DOCUMENTS

JP 2001250420 A * 9/2001

* cited by examiner

*Primary Examiner* — Darnell M Jayne
*Assistant Examiner* — Patrick Hawn

(57) ABSTRACT

A shelving system includes an upper wall that has a bottom surface. A panel has a top side, a bottom side, a first lateral edge, a second lateral edge, a front edge and a rear edge. The panel has four corners. A plurality of tethers each has a first end and a second end. Each of the first ends is attached to the bottom surface and each of the second ends is attached to the panel. The corners each have one of the second ends positioned adjacent thereto when the tethers are suspended from the upper wall. The tethers suspend the panel from the upper wall a distance equal to at least 8 inches. A plurality of couplers releasably couple the panel to the upper wall in a stored position spaced from the upper wall a distance of less than 4 inches.

4 Claims, 6 Drawing Sheets

SHELVING SYSTEM

BACKGROUND OF THE DISCLOSURE

1. Field of the Disclosure

The disclosure relates to shelving devices and more particularly pertains to a new shelving device for mounting to a ceiling of a camper to provide for additional storage space and which can be collapsed when not in use.

2. Summary of the Disclosure

An embodiment of the disclosure meets the needs presented above by generally comprising an upper wall that has a bottom surface. A panel has a top side, a bottom side, a first lateral edge, a second lateral edge, a front edge and a rear edge. The panel has four corners. A plurality of tethers each has a first end and a second end. Each of the first ends is attached to the bottom surface and each of the second ends is attached to the panel. The corners each have one of the second ends positioned adjacent thereto when the tethers are suspended from the upper wall. The tethers suspend the panel from the upper wall a distance equal to at least 8 inches. A plurality of couplers releasably couple the panel to the upper wall in a stored position spaced from the upper wall a distance of less than 4 inches.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
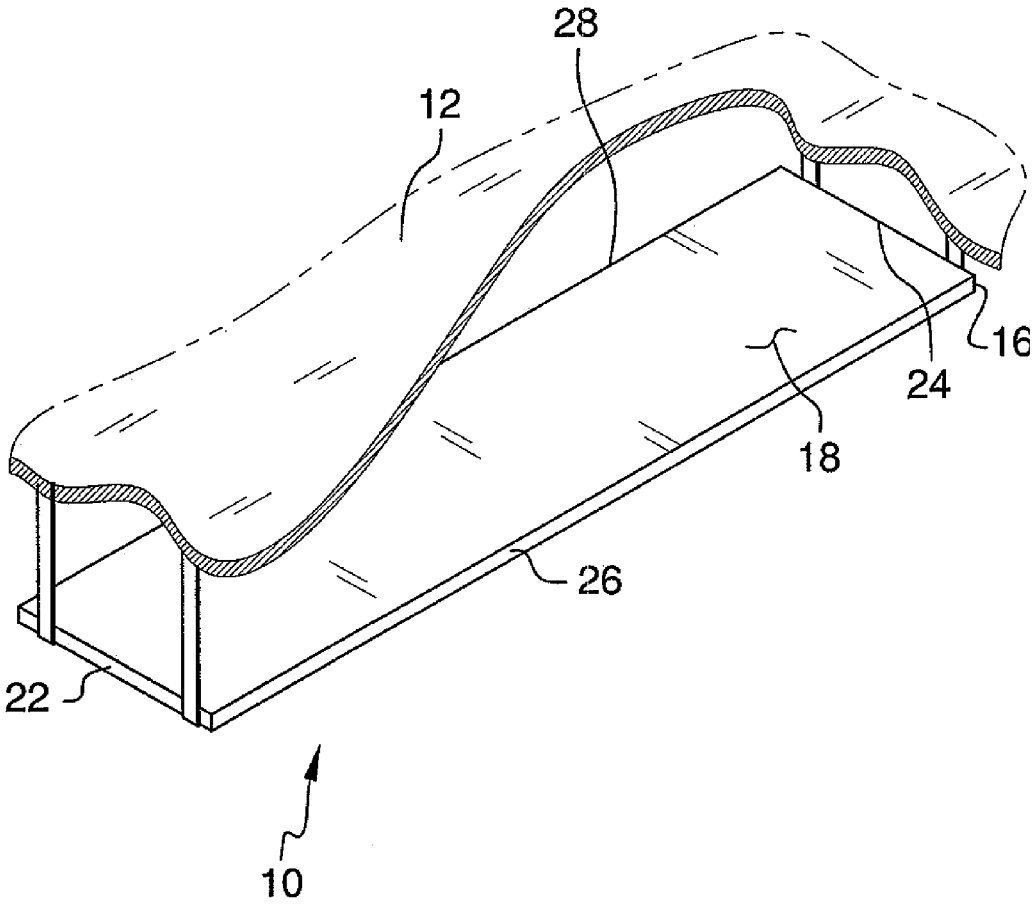
FIG. 1 is a broken top perspective view of a shelving system according to an embodiment of the disclosure.

With reference now to the drawings, and in particular to FIGS. 1 through 5 thereof, a new shelving device embodying the principles and concepts of an embodiment of the disclosure and generally designated by the reference numeral 10 will be described.

As best illustrated in FIGS. 1 through 5, the shelving system 10 generally comprises an upper wall 12 having a bottom surface 14. The upper wall 12 is a ceiling of a collapsible camper, conventionally known as pop-up campers towed by vehicles and which include a rigid lower body and flexible upper body which allows the camper to collapse for easy transportation purposes. Because they collapse, these types of campers cannot have fixed cabinetry. One type of such campers is sold under the trademark Coleman and are manufactured by FTCA Inc. of Somerset, Pa.

Figure 1A:
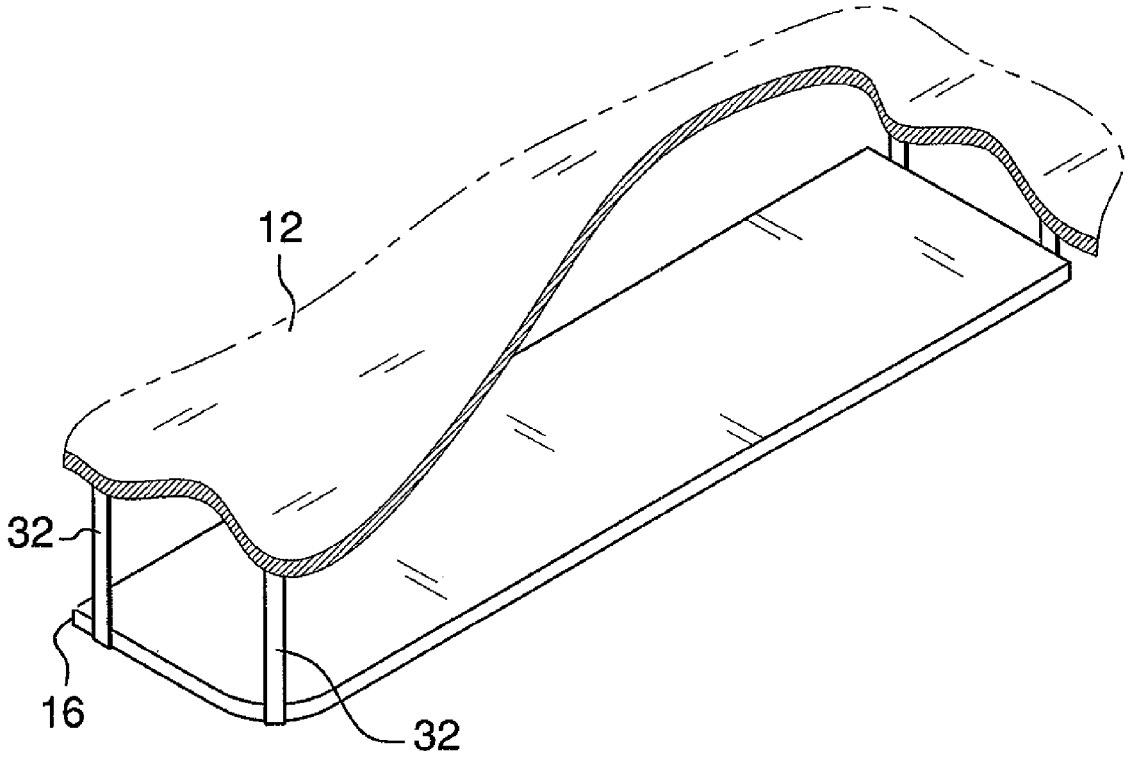
FIG. 1A is a broken top perspective view of a second embodiment of the disclosure.
Figure 2:
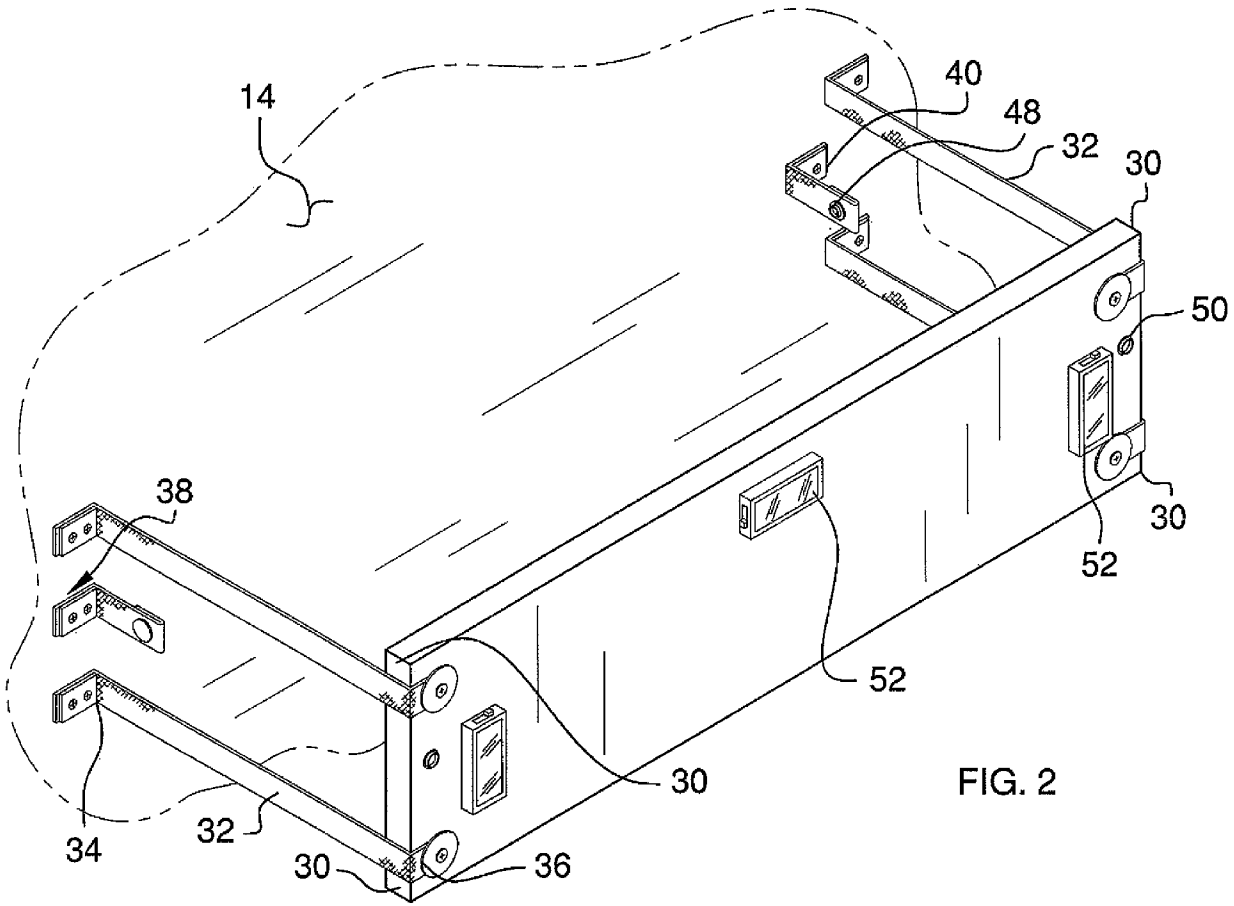
FIG. 2 is a bottom perspective view of an embodiment of the disclosure.
Figure 2A:
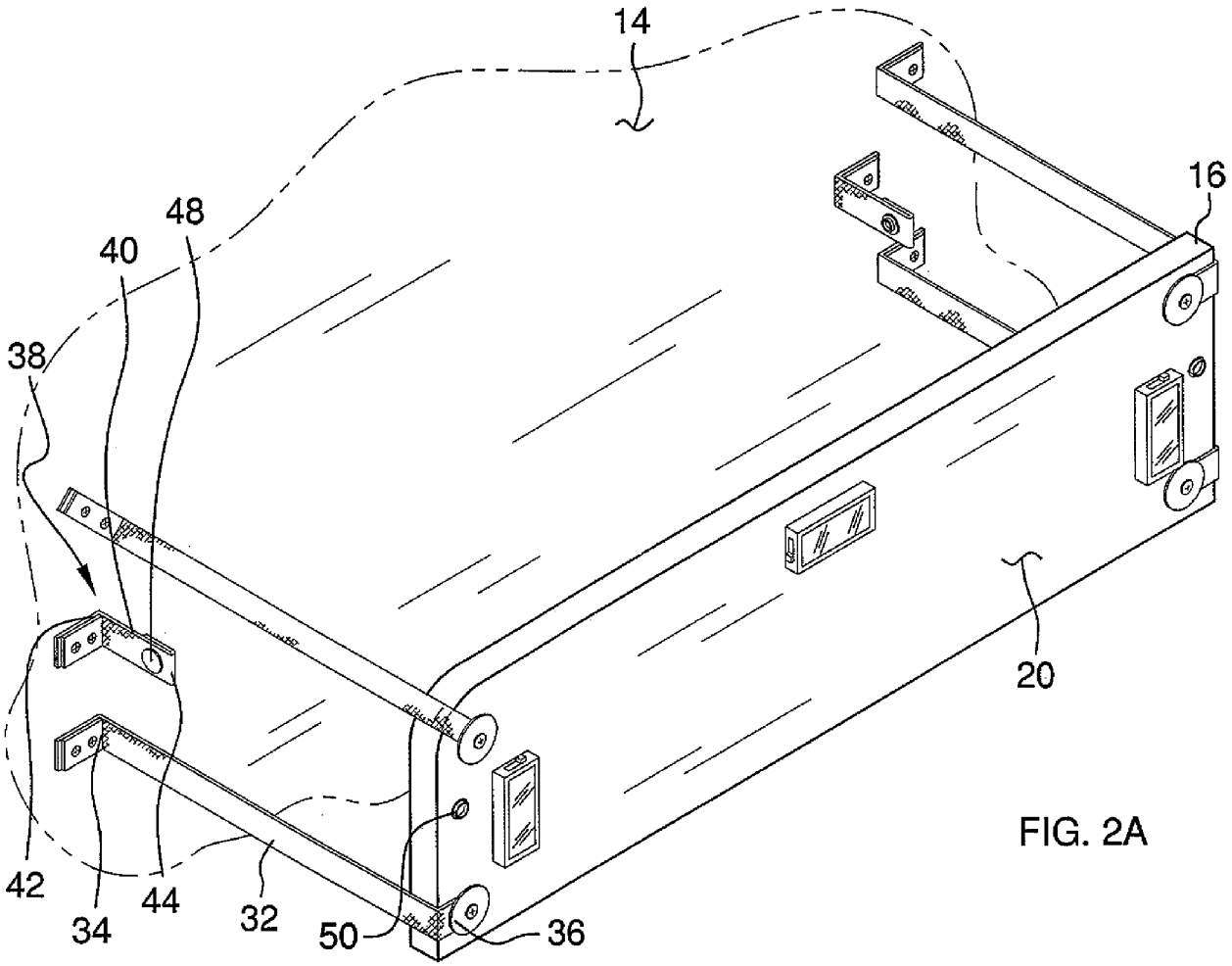
FIG. 2A is a bottom perspective view of a second embodiment of an embodiment of the disclosure.
Figure 3:
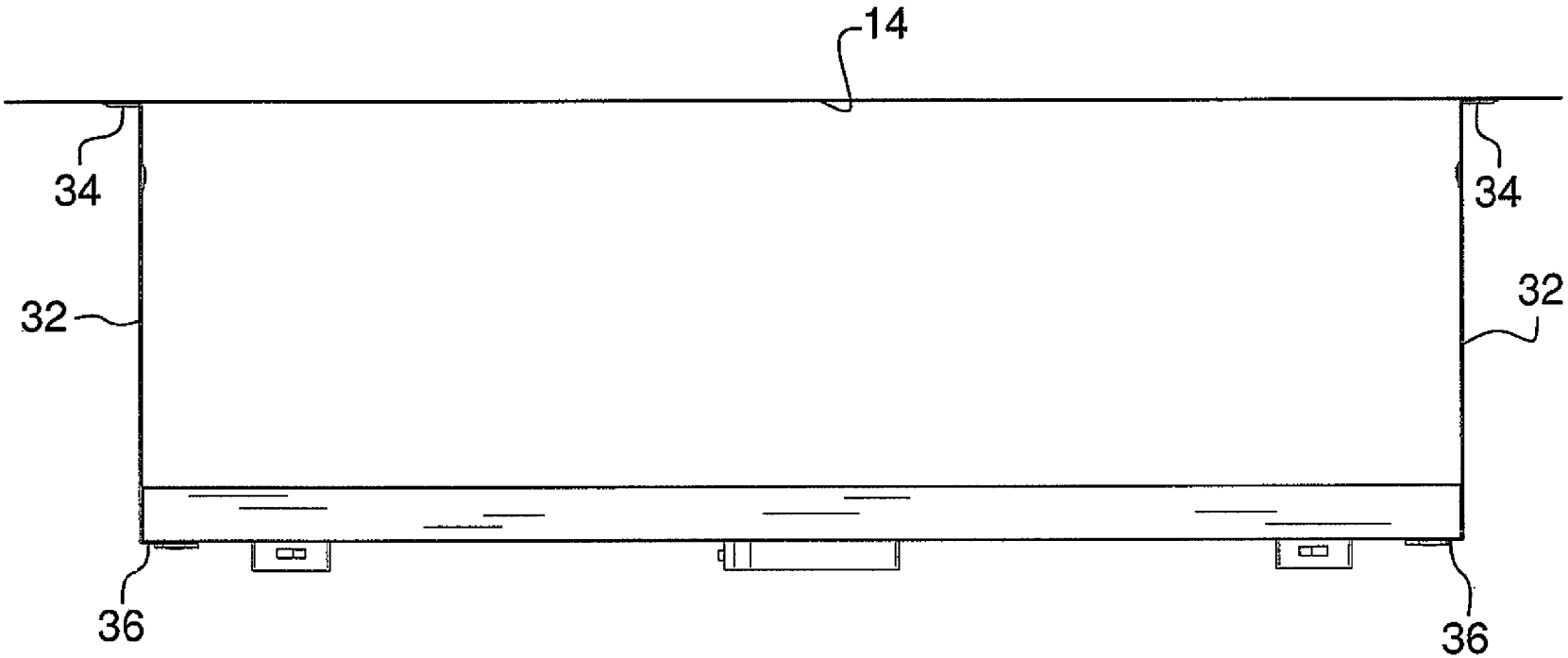
FIG. 3 is a front view of an embodiment of the disclosure.
Figure 4:
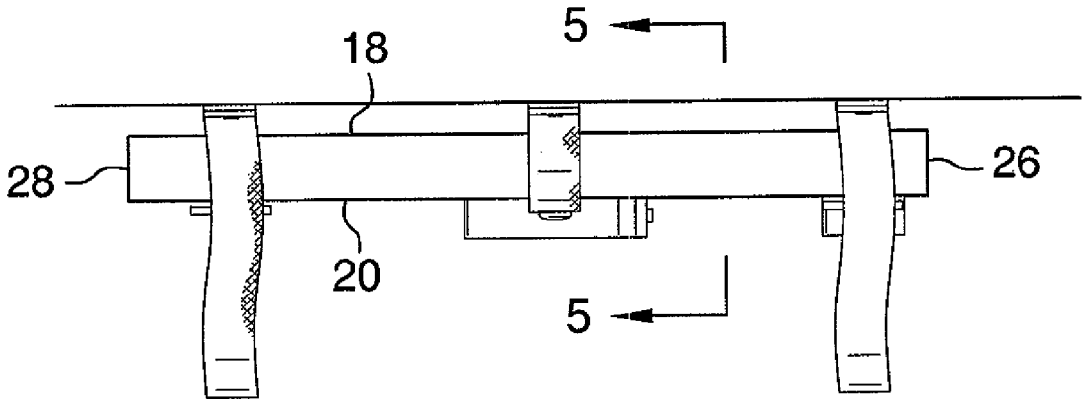
FIG. 4 is a side view of an embodiment of the disclosure.
Figure 5:
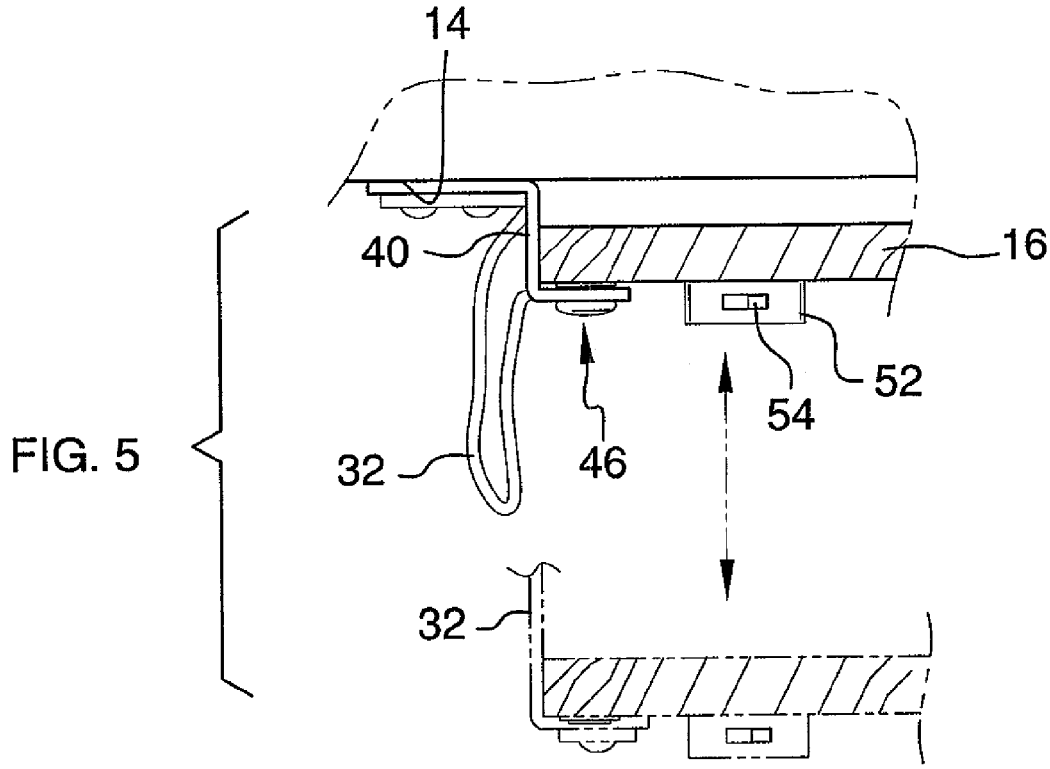
FIG. 5 is a cross-sectional view of an embodiment of the disclosure taken along line 5-5 of FIG. 4.

The system 10 further includes a panel 16 that has a top side 18, a bottom side 20, a first lateral edge 22, a second lateral edge 24, a front edge 26 and a rear edge 28. The panel 16 has four corners 30. One of the corners 30 may be arcuate as shown in FIGS. 1A and 2A for reasons discussed below.

A plurality of tethers 32 each has a first end 34 and a second end 36. Each of the first ends 34 is attached to the bottom surface 14 and each of the second ends 36 is attached to the panel 16. Each of the corners 30 has one of the second ends 36 positioned adjacent thereto when the tethers 32 are suspended from the upper wall 12. The tethers 32 suspend the panel 16 from the upper wall 12 a distance equal to at least 8 inches and up to 24 inches. Each of the tethers 32 comprises a flexible material such as a canvas or nylon material. The second ends 36 are attached to the bottom side 20 of the panel 16 so that two of the tethers 32 extend around and abut the first lateral edge 22 and two of the tethers 32 extend around and abut the second lateral edge 24.

A plurality of couplers 38 releasably couple the panel 12 to the upper wall 12 in a stored position spaced from the upper wall 12 a distance of less than 4 inches. Each of the couplers 38 is attached to the bottom surface 20 and is releasably engaged to the panel 12 when the panel is in the stored position. Each of the couplers 38 comprises a strap 40 having an upper end 42 and a lower end 44. The upper end 42 is attached to the bottom surface 14. A fastener 46 releasably couples the strap 40 to the panel 16. The fastener 46 includes a first mating member 48 and a second mating member 50. The first mating member 48 is attached to the strap 40 adjacent to the lower end 44 and the second mating member 50 is attached to the panel 16. The second mating member 50 is positioned on the bottom surface 20 of the panel 16. The fastener 46 may comprise a snap fastener. The plurality of couplers 38 includes at least two couplers 38.

At least one light emitter 52 is attached to the bottom surface 20 and is actuatable to emit light downwardly from the panel 16. The light emitter(s) 52 may be attached to the bottom surface 20 with conventional fastening means or with an adhesive and include a switch 54 that is actuated to turn the light emitter(s) 52 on or off. FIG. 2 depicts a version of the system 10 including three light emitters 52.

In use, when the pop up camper has its upper body lifted to the deployed position, the panel 16 is released from the couplers 38 to allow the panel 16 to hang a sufficient distance from the upper wall 12 to allow items to be placed on the panel 16. This increases the usable shelf space of the camper. When the upper body is lowered, the panel 16 is placed in the stored position to ensure that it does not interfere with other articles positioned in the lower body of the camper. If the panel 16 is positioned adjacent to a door of the camper, one of the corners 30 may be rounded to prevent injury to a person who might strike their head on the panel 16 while entering or leaving the camper.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A shelving system comprising:

an upper wall having a bottom surface;

a panel having a top side, a bottom side, a first lateral edge, a second lateral edge, a front edge and a rear edge, said panel having four corners;

a plurality of tethers each having a first end and a second end, each of said first ends being attached to said bottom surface, each of said second ends being attached to said panel, each of said corners having one of said second ends positioned adjacent thereto when said tethers are suspended from said upper wall, said tethers suspending said panel from said upper wall a distance equal to at least 8 inches, said second ends are attached to said bottom side of said panel so that two of said tethers extend around and abut said first lateral edge and two of said tethers extend around and abut said second lateral edge;

a plurality of couplers releasably couple said panel to said upper wall in a stored position spaced from said upper wall a distance of less than 4 inches, each of said couplers being attached to said bottom surface and is releasably engaged to said panel when said panel is in said stored position, each of said couplers comprises a strap having an upper end and a lower end, said upper end being attached to said bottom surface; and a fastener releasably coupling said strap to said panel, said fastener including a first mating member and a second mating member, said first mating member being attached to said strap adjacent to said lower end, said second mating member being attached to said panel, said second mating member being positioned on said bottom side of said panel.

2. The system according to claim 1, wherein each of said tethers comprises a flexible material.

3. The system according to claim 1, further including at least one light emitter being attached to said bottom side and being actuatable to emit light downwardly from said panel.

4. A shelving system comprising:

an upper wall having a bottom surface, said upper wall being a ceiling of a collapsible camper;

a panel having a top side, a bottom side, a first lateral edge, a second lateral edge, a front edge and a rear edge, said panel having four corners;

a plurality of tethers each having a first end and a second end, each of said first ends being attached to said bottom surface, each of said second ends being attached to said panel, each of said corners having one of said second ends positioned adjacent thereto when said tethers are suspended from said upper wall, said tethers suspending said panel from said upper wall a distance equal to at least 8 inches, each of said tethers comprising a flexible material, said second ends being attached to said bottom side of said panel so that two of said tethers extend around and abut said first lateral edge and two of said tethers extend around and abut said second lateral edge;

a plurality of couplers releasably couple said panel to said upper wall in a stored position spaced from said upper wall a distance of less than 4 inches, each of said couplers being attached to said bottom surface and being releasably engaged to said panel when said panel is in said stored position, each of said couplers comprises;

a strap having an upper end and a lower end, said upper end being attached to said bottom surface;

a fastener releasably coupling said strap to said panel, said fastener including a first mating member and a second mating member, said first mating member being attached to said strap adjacent to said lower end, said second mating member being attached to said panel, said second mating member being positioned on said bottom side of said panel, said fastener comprising a snap fastener; and at least one light emitter being attached to said bottom side and being actuatable to emit light downwardly from said panel.

* * * * *